US009981305B2

(12) United States Patent
Dixit et al.

(10) Patent No.: US 9,981,305 B2
(45) Date of Patent: May 29, 2018

(54) TOOL ASSEMBLY AND METHOD FOR MANUFACTURING AN AUTOMOTIVE BODY PANEL

(71) Applicant: GM Global Technology Operations LLC, Detroit, MI (US)

(72) Inventors: Ritesh Dixit, Bangalore (IN); Yi-Chun Li, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 24 days.

(21) Appl. No.: 15/189,560

(22) Filed: Jun. 22, 2016

(65) Prior Publication Data

US 2017/0368594 A1 Dec. 28, 2017

(51) Int. Cl.

| | |
|---|---|
| ***B21D 28/00*** | (2006.01) |
| ***B21D 28/02*** | (2006.01) |
| ***B21D 53/88*** | (2006.01) |
| ***B21D 22/02*** | (2006.01) |
| *B21D 28/10* | (2006.01) |

(52) U.S. Cl.

CPC ..... *B21D 53/88* (2013.01); *B21D 22/02* (2013.01); *B21D 28/00* (2013.01); *B21D 28/02* (2013.01); *B21D 28/10* (2013.01)

(58) Field of Classification Search

CPC ..... B21D 28/00; B21D 28/02; B21D 28/10; B21D 28/22; B21D 28/24; B21D 28/34; B21D 28/343; B21D 22/30; B21D 22/04; B21D 53/74; B21D 53/88

See application file for complete search history.

(56) References Cited

U.S. PATENT DOCUMENTS

| | | | | |
|---|---|---|---|---|
| 6,408,516 | B1 * | 6/2002 | Taylor | B21D 53/88 29/430 |
| 9,296,430 | B2 * | 3/2016 | Yonebayashi | B21D 53/88 |

* cited by examiner

*Primary Examiner* — R. K. Arundale
*Assistant Examiner* — Pradeep C Battula

(57) ABSTRACT

A method for manufacturing a body panel, the method includes drawing a metal sheet into a body panel, trimming a first and second portion of the body panel to form a first and second opening and a cross member. The cross member extends between the first and second openings. The method further includes trimming a portion of the cross member to form a first and a second retention tab and forming a flange in the edge of the first opening, the edge of the second opening and the first and second retention tabs. The method further includes trimming the first and second retention tabs at the edge of the first and second opening.

16 Claims, 5 Drawing Sheets

TOOL ASSEMBLY AND METHOD FOR MANUFACTURING AN AUTOMOTIVE BODY PANEL

FIELD

The invention relates generally to metal stamping and more particularly to metal stamping automotive body panels demanding high precision specifications.

BACKGROUND

The statements in this section merely provide background information related to the present disclosure and may or may not constitute prior art.

Traditional automotive body panel stamping and trimming processes used to make roof panels that include a sunroof have been used with great success for achieving the specified dimensions and tolerances required by designers. However, new product designs have stretched beyond the dimensional and quality capability of current processes. Therefore, to continue producing the new product designs under the current processes creates new challenges. For example, the traditional stamping processes require the use of additional dies, air trimming, and lancing to achieve the dimensional capability required by designers. Additional dies adds to tooling, machining, maintenance, and labor costs. Air trimming affects body panel quality as the body panel is supported on only one side during trim causing deflection and trim steel wear out. Lancing operations lead to safety issues as overhanging scrap interferes with handling the body panel between operations. Furthermore, lancing increases sliver production leading to poor body panel surface quality.

As a whole, the quality, cost, and safety challenges facing body panel manufacturers would render the new designs too costly to incorporate into new vehicle models. Thus, there is a need in the art for a new stamping manufacturing process that improves dimensional capability, lowers cost, improves product quality, and ensures worker safety.

SUMMARY

A method and a tool assembly for manufacturing a body panel is provided in one aspect of the present invention. The method includes drawing a metal sheet into a body panel. The method further includes trimming a first and second portion of the body panel to form a first and second opening and a cross member. The cross member extends from an edge of the first opening to an edge of the second opening. The method further includes trimming a portion of the cross member to form a first and a second retention tab and forming a flange in the edge of the first opening, the edge of the second opening and the first and second retention tabs. The method further includes trimming the first and second retention tabs at the edge of the first and second opening.

In another aspect of the present invention, the method further includes providing a first tool assembly having an upper trim steel, and wherein the upper trim steel trims the portion of the cross member to form the first and second retention tabs.

In yet another aspect of the present invention, providing a first tool assembly further includes providing an upper flange steel to form the flange in the edge of the first and second openings and the first and second retention tabs.

In yet another aspect of the present invention, forming a flange further comprises holding the retention tabs while forming the flange.

In yet another aspect of the present invention, providing a first tool assembly further comprises providing a tab retainer to hold the retention tabs.

In yet another aspect of the present invention, trimming a first and second portion of the body panel further includes trimming at least one locator tab in the edge of one of the first and second openings.

In yet another aspect of the present invention, the method further includes piercing a locator hole in the at least one locator tab.

In yet another aspect of the present invention, the method further includes providing a second tool assembly having an upper trim steel and wherein the upper trim steel trims the first and second retention tabs at the edge of the first and second opening.

In yet another aspect of the present invention, providing a second tool assembly further comprises providing a pierce die for piercing the locator hole into the at least one locator tab.

In yet another aspect of the present invention, tool assembly for manufacturing a body panel having an opening with a cross member is provided. The tool assembly includes a top and a bottom die. The top die has at least one upper trim steel, an upper flange steel, an upper post, and at least one upper body panel retainer. The upper flange steel is disposed proximate a perimeter of the opening of the body panel. The at least one upper trim steel is disposed proximate the cross member of the body panel. The at least one upper body panel retainer is disposed between the at least one upper trim steel and the upper flange steel.

In yet another aspect of the present invention, the bottom die has a lower post, at least one lower trim steel, at least one lower body panel retainer pad, and a lower flange steel.

In yet another aspect of the present invention, the top die and the bottom die are disposed in at least a first and a second position.

In yet another aspect of the present invention, a bottom surface of the at least one body panel retainer is lower than a bottom edge of the at least one upper trim steel.

In yet another aspect of the present invention, when the top and bottom dies are disposed in the first position, the at least one upper body panel retainer is in contact with a top surface of the cross member of the body panel. The at least one lower body panel retainer pad is in contact with a bottom surface of the cross member of the body panel. The upper flange steel is above the body panel. The at least one upper trim steel is disposed below the at least one lower trim steel after trimming a portion of the cross member of the body panel.

In yet another aspect of the present invention, when the top and bottom dies are disposed in the second position, the at least one upper body retainer is disposed on the top surface of the cross member of the body panel. The at least one lower body panel retainer pad is disposed on the bottom surface of the cross member of the body panel. The upper flange steel is disposed in contact with an edge of the opening of the body panel after combining with the lower flange steel to form a flange in the edge of the opening of the body panel.

Further aspects, examples, and advantages will become apparent by reference to the following description and appended drawings wherein like reference numbers refer to the same component, element or feature.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1A:
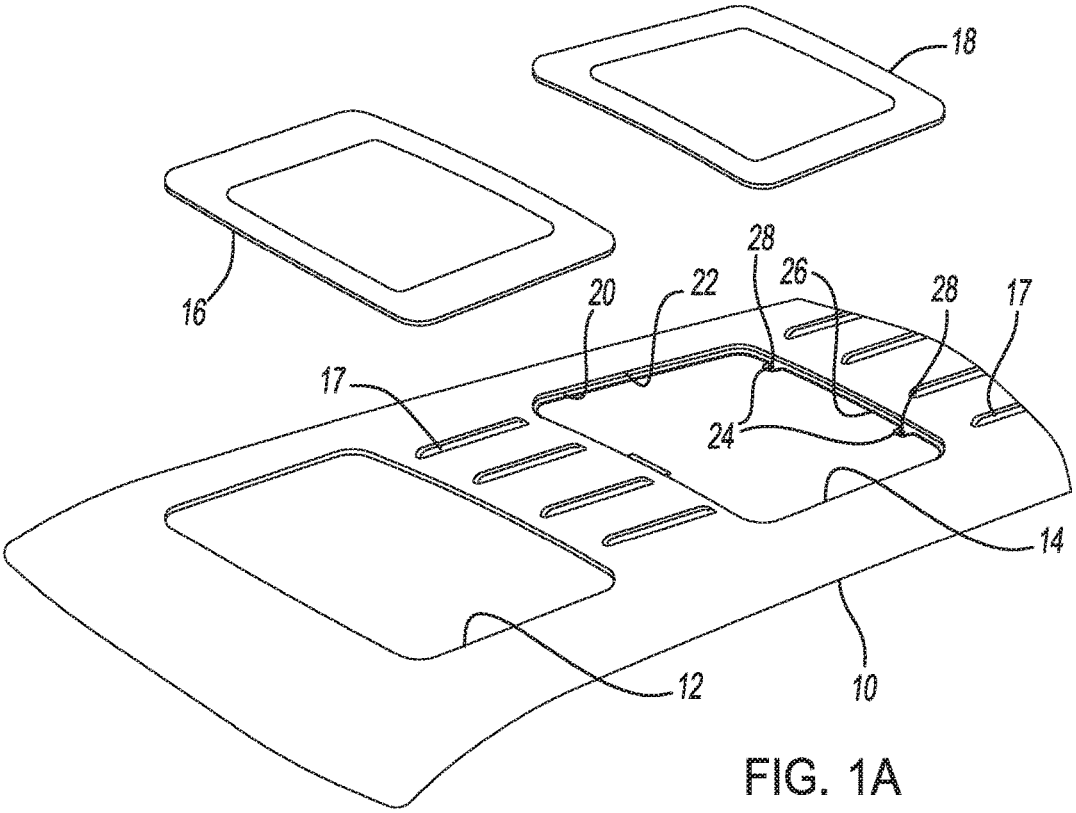
FIG. 1A is a perspective view of a portion of an exemplary automobile roof body panel, according to the present invention.
Figure 1B:
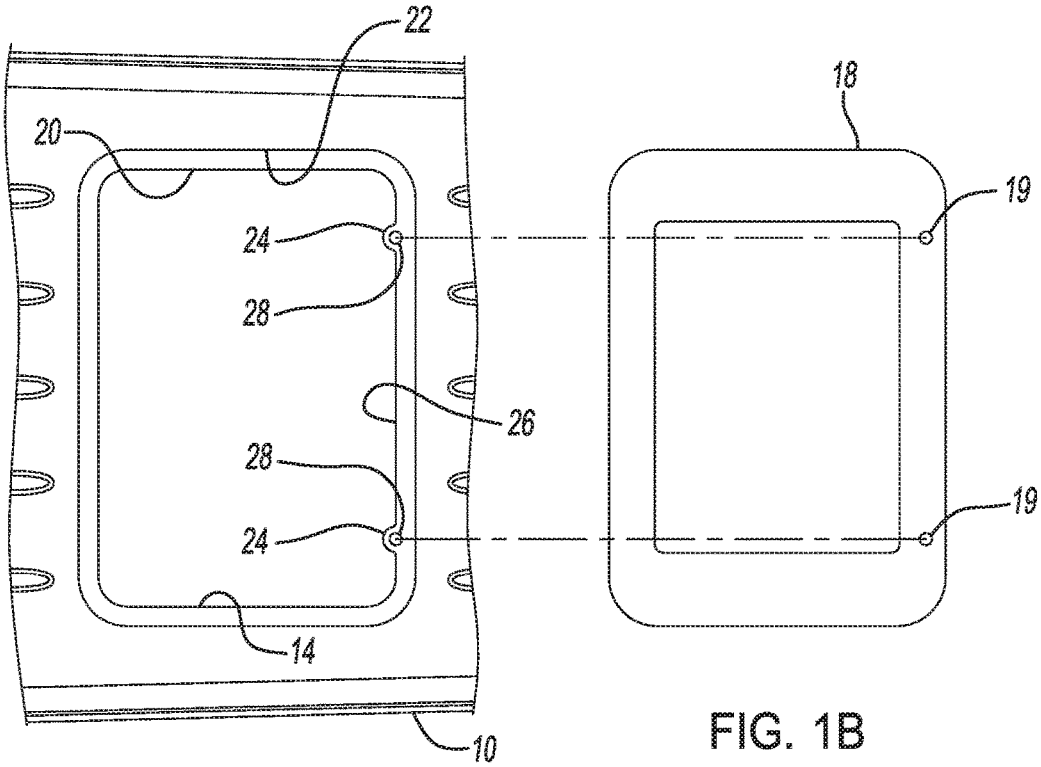
FIG. 1B is a top exploded view of a portion of an exemplary automobile roof body panel and sunroof, according to the present invention.

With reference to FIGS. 1A and 1B, a portion of a roof body panel 10 of an automobile is illustrated and will now be described. The roof body panel 10 includes a first sunroof opening 12 and a second sunroof opening 14 in which a first and a second sunroof assembly 16, 18 may be installed, respectively. Additionally, the roof body panel 10 includes a plurality of strengthening channels 17. The plurality of strengthening channels 17 are configured and formed in the second sunroof assembly 18 to increase the rigidity and prevent excessive flexing of the roof body panel 10. The first sunroof opening 12 is disposed approximately above the portion of the interior of the automobile that includes the front seats (not shown). The second sunroof opening 14 is disposed approximately above the portion of the interior of the automobile that includes the second row of or rear seats (not shown). In the instant embodiment of the present invention, the first sunroof assembly 16 may be mounted in the first sunroof opening 12. The first sunroof assembly 16 may be moveable from a closed position to an open position. In contrast, the second sunroof assembly 18 may be mounted in the second sunroof opening 14. The second sunroof assembly 18 may be non-moveable or fixed. However, alternative arrangements of fixed or moveable sunroof assemblies are possible without departing from the scope of the invention. In the instant example, the second sunroof assembly 18 is a fixed sunroof having a pair of locator post 19. The second sunroof opening 14 includes a flange 20 on the interior perimeter 22 of the second sunroof opening 14 and a first and second locator tabs 24 extending from the rear edge 26 of the second sunroof opening 14. Additionally, the first and second locator tabs 24 each include a hole 28 through which the locator post 19 second sunroof assembly 18 are disposed in order to locate the second sunroof assembly 18 in the second sunroof opening 14 of the second sunroof assembly 18.

Figure 2:
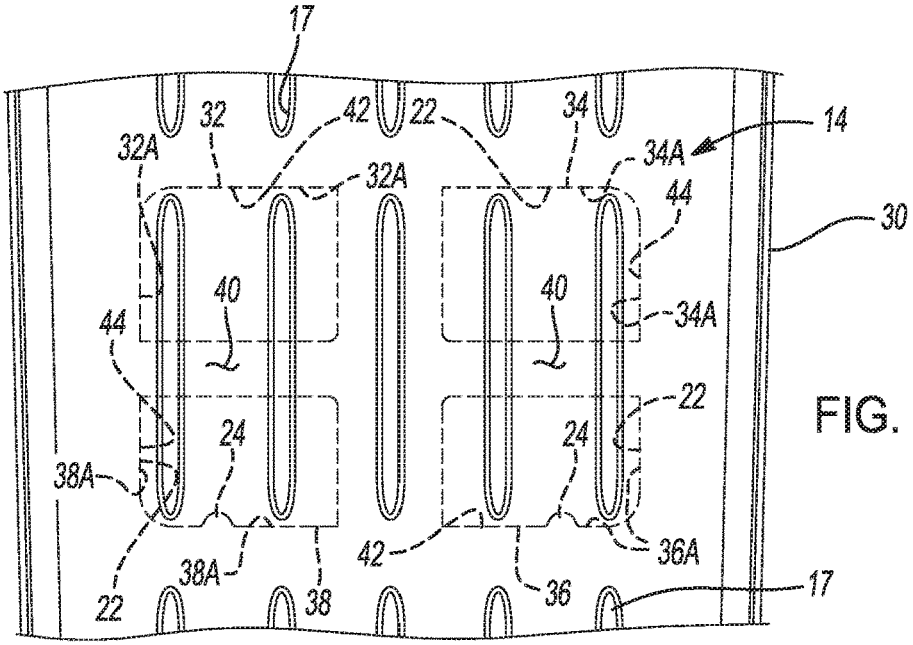
FIG. 2 is a plan view of a portion of an exemplary automobile roof body panel after partial processing, according to the present invention.
Figure 3:
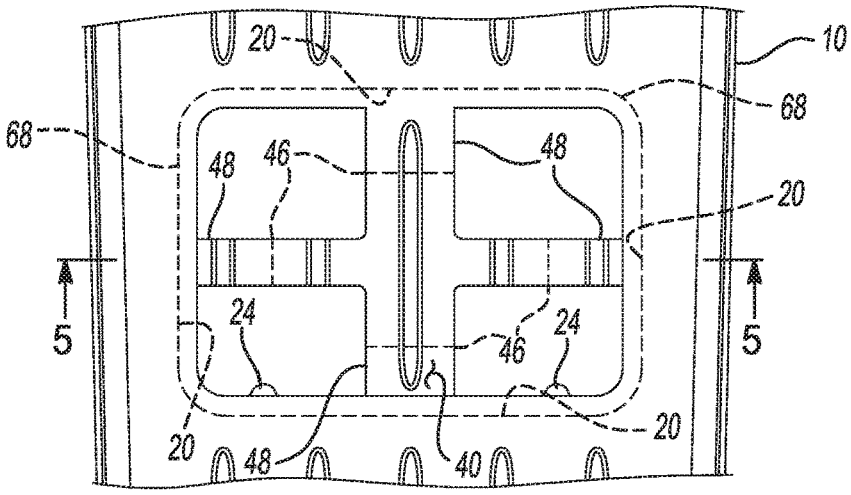
FIG. 3 is a plan view of a portion of an exemplary automobile roof body panel after partial processing, according to the present invention.
Figure 4:
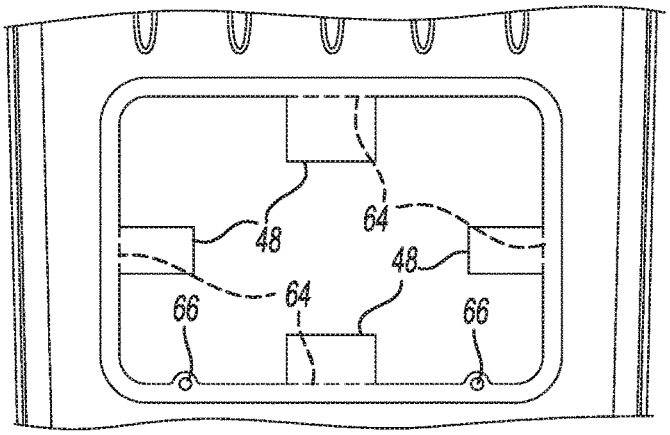
FIG. 4 is a plan view of a portion of an exemplary automobile roof body panel after processing, according to the present invention.

Turning now to FIGS. 2-4, a portion of the roof body panel 10 is illustrated in progressive stages of manufacture. For example, FIG. 2 shows the roof body panel 10 after an initial operation or step of forming the general shape of the roof body panel 10, the strengthening channels 17, and trimming an outer perimeter of the roof body panel 10. The second operation trims a first, second, third, and fourth openings 32, 34, 36, 38 along the dash lines of FIG. 2 forming the general shape of the second sunroof opening 14. Outer adjacent edges 32A, 34A, 36A, 38A of each of the openings 32, 34, 36, 38 combine to form an interior perimeter 22 of the second sunroof opening 14. Thus the remaining portion of the roof body panel 10 forms a cross member 40 connecting opposite edges 42, 44 of the interior perimeter 22 of the second sunroof opening 14. Furthermore, the first and second locator tabs 24 are trimmed into the rear edge 36A, 38A of the openings 36, 38. One of the important benefits of the second operation is the cross member 40 maintains connectivity to the remainder of the roof body panel 10 which eliminates or prevents unattached edges or scrap of the roof body panel 10 from getting trapped or caught in the tool or machine during transfer of the roof body panel 10 to the next operation. Furthermore, the elimination of the unattached edges or scrap improves the safety of the machine operator when transferring the roof body panel 10 between dies.

Figure 5A:
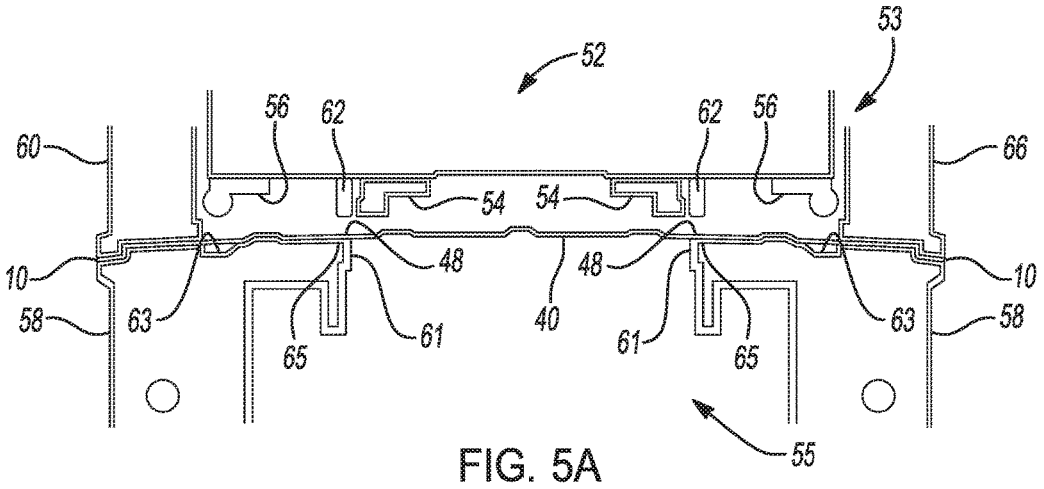
FIGS. 5A-5C are cross sectional views of a stamp and trim tool assembly and a portion of the exemplary automobile roof body panel as indicated by the section line 5 shown in FIG. 3, according to the present invention.

A third operation for manufacturing the roof body panel 10 is depicted in FIGS. 3 and 5A-5C. FIG. 3 illustrates where the third operation trims and forms the roof body panel 10 while FIG. 5A is a cross sectional view of the roof body panel 10 and a tool assembly 52 after the roof body panel 10 is placed into the tool assembly 52 prior to the third operation. The third operation includes two steps each performed by the tool assembly 52. The first step of the third operation includes trimming a portion of the cross member 40 as shown by the dashed lines 46 of FIG. 3 to create four retention tabs 48. The four retention tabs 48 of the cross member 40 are no longer connected to each other. The second step of the third operation includes forming of the flange 20 as depicted by the dash line 68.

Figure 5B:
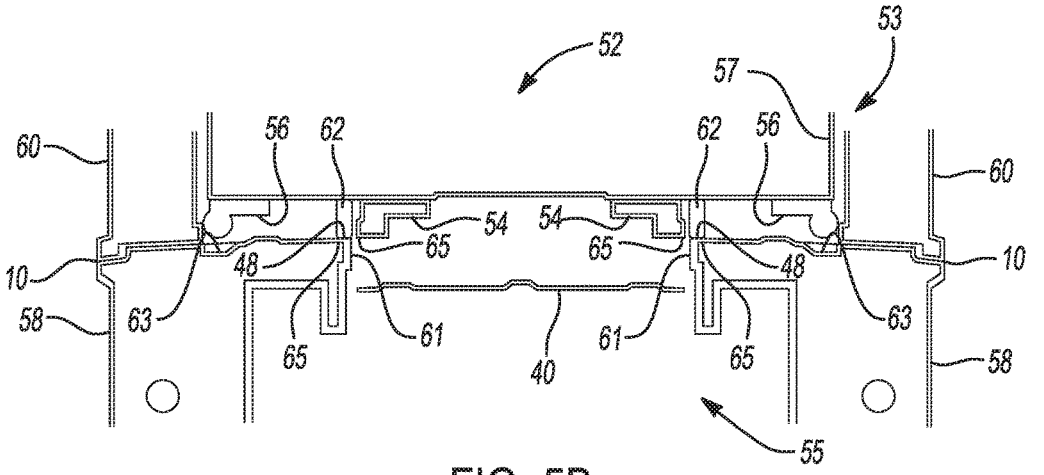
Figure 5C:
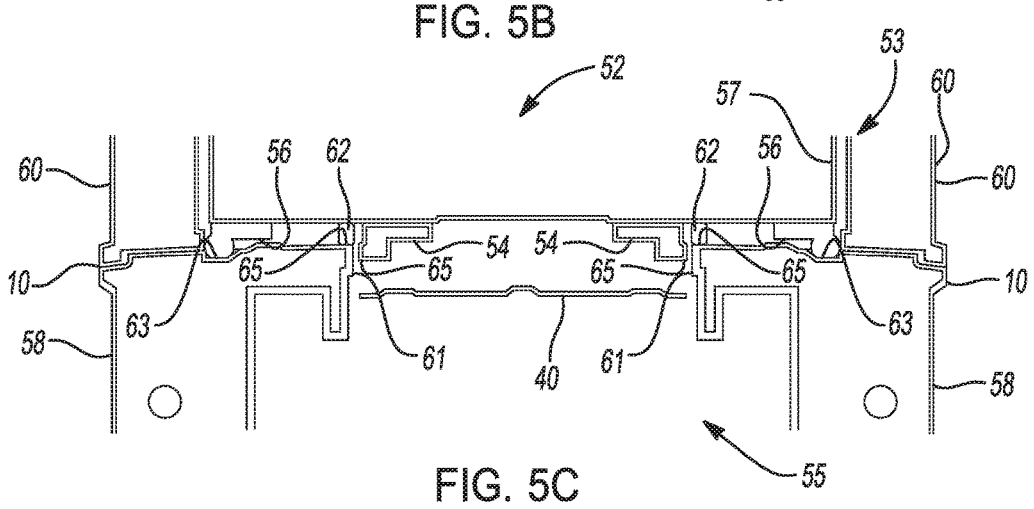
Figure 6A:
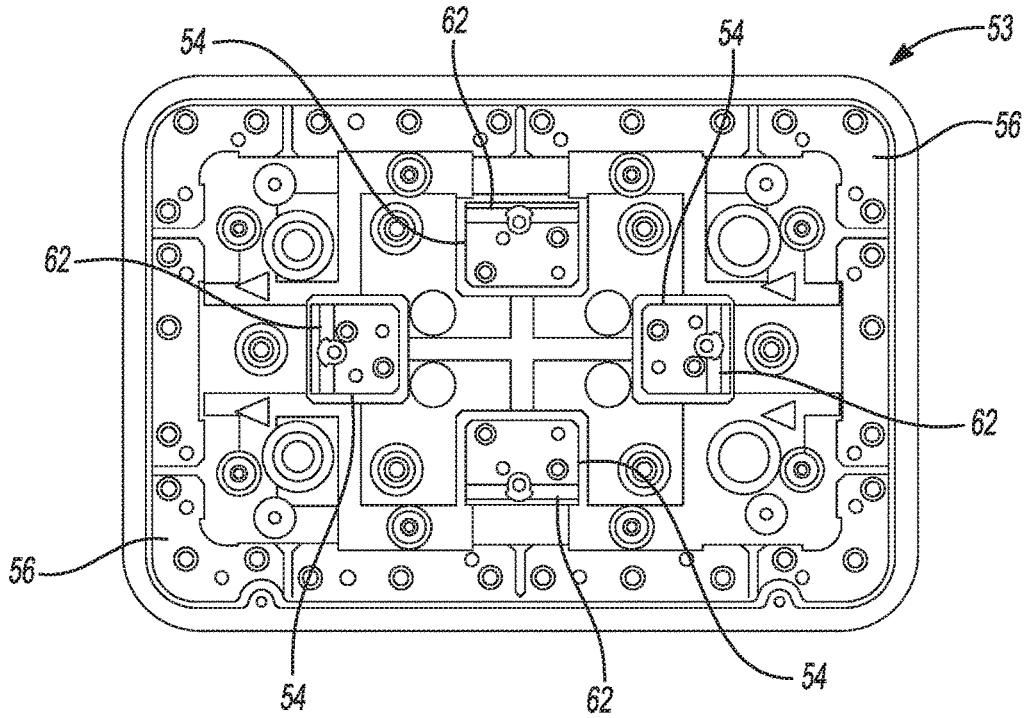
FIG. 6A is a bottom view of a top half of a stamp and trim tool assembly used in a method of manufacturing an automobile roof body panel, according to the present invention.
Figure 6B:
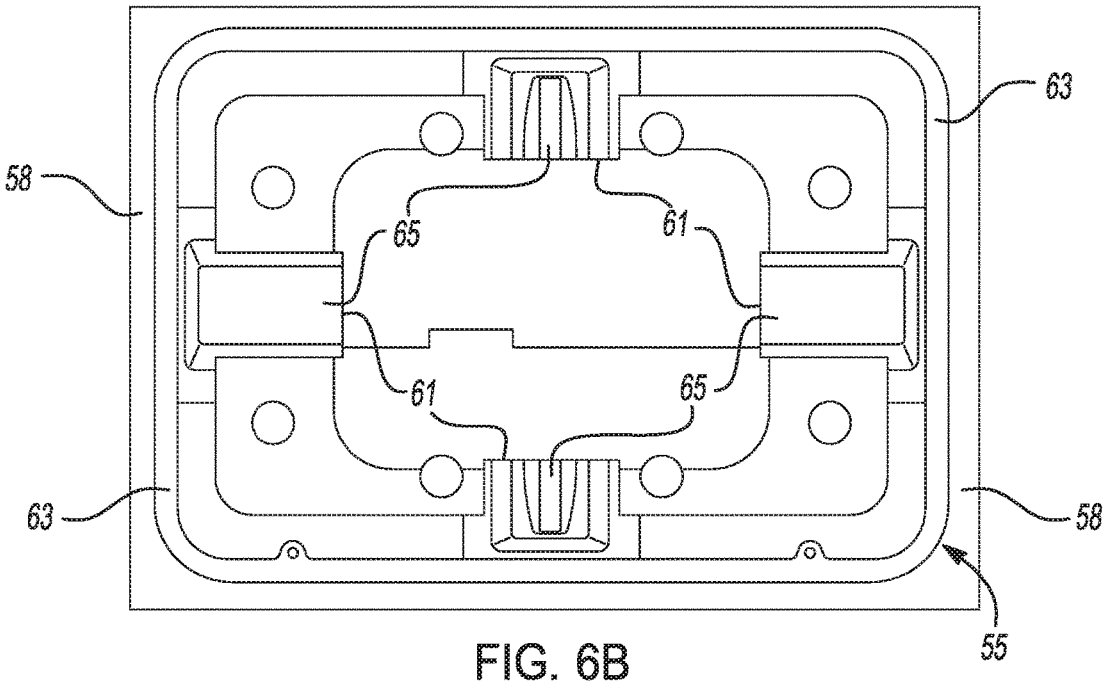
FIG. 6B is a top view of the bottom half of a stamp and trim tool assembly used in a method of manufacturing an automobile roof body panel, according to the present invention.

Turning now to FIGS. 5A-5C, 6A and 6B, with continued reference to FIG. 3, the progression of the third operation is shown. In FIGS. 5A, 6A, and 6B the tool assembly 52 includes a top die 53 and a bottom die 55. More particularly, the top die 53 includes an upper trim steel 54, an upper flange steel 56, an upper pad 60, and an upper tab retainer or member 62. The upper pad 60 is disposed at the outer perimeter of the top die 53. The upper flange steel 56 is disposed adjacent to the upper pad 60. The upper trim steel 54 is disposed on an interior portion of the top die 53 with the upper tab retainer 62 disposed between the upper flange steel 56 and the upper trim steel 54.

The bottom die 55 includes a lower post 58, a lower trim steel 61, a lower flange steel 63, and a lower tab retainer pad 65. Similar to the top die 53, the lower post 58 is disposed on the perimeter of the bottom die 55 and interacts or combines with the upper pad 60 to hold the outer perimeter of the roof body panel 10. The lower flange steel 63 is disposed adjacent to the lower post 58 and combines with the upper flange steel 56 to form the flange 20. The lower trim steel 61 is disposed opposite and works in combination with the upper trim steel 54 to trim the cross member 40. The lower tab retainer pad 65 is disposed between the lower flange steel 63 and the lower trim steel 61 and combines with the upper tab retainer 62 to hold the cross member 40 of the roof body panel 10 during trimming and flanging.

As the roof body panel 10 is inserted into the tool assembly 52, the upper pad 60 is lowered to contact the top surface of the roof body panel 10. In particular, the upper pad 60 contacts the top surface of the roof body panel 10 while the lower post 58 supports the bottom surface of the roof body panel 10 around the perimeter of the second sunroof opening 14. Furthermore, as the tool assembly 52 is lowered, the upper tab retainer 62 is lowered to hold the top surface of the retention tabs 48 of the cross member 40 as the bottom surface of the retention tabs 48 of the cross member 40 is supported by the lower tab retainer pad 65. The upper tab retainer 62 and the lower tab retainer pad 65 combine to support the roof body panel 10 on the top and bottom surfaces of the roof body panel 10 thus preventing deflection of the roof body panel 10 as the upper trim steel 54 contacts and trims the cross member 40 against the lower trim steel 61 and the upper flange steel 56 combines with the lower flange steel 63 to form the flange 20.

FIG. 5B shows the position of the upper trim steel 54 and the upper flange steel 56 after the upper trim steel 54 has lowered passed the lower trim steel 61. The upper tab retainer 62 is further compressed as the cross member 40 has been trimmed to the dashed lines 46 with the retention tabs 48 of the cross member 40 still retained between the upper tab retainer 62 and the lower tab retainer pad 65.

FIG. 5C shows the position of the upper trim steel 54 and the upper flange steel 56 as the upper flange steel 56 engages with the edge of the second sunroof opening 14 and the lower flange steel 63 to form the flange 20 into the roof body panel 10, thus creating the continuous interior flange 20 of the second sunroof opening 14. The upper pad 60 and upper tab retainer 62 remain in position against the lower post 58 and lower tab retainer pad 65 further preventing deflection as the upper flange steel 56 forms the flange 20 of the roof body panel 10.

Turning now to FIGS. 6A and 6B, FIGS. 6A and 6B illustrate the top and bottom dies 53, 55 of the tool assembly 52. The top die 53 shown in FIG. 6A includes the upper trim steel 54, the upper tab retainer 62, the upper flange steel 56, and the upper pad 60 secured to the top die 53. In particular, the upper tab retainer 62 is a resilient member that compresses as pressure is increased. The upper tab retainer 62 is constructed from a compressible plastic, rubber, or urethane, however, the upper tab retainer 62 may be made from other materials and construction without departing from the scope of the invention. The bottom die 55 of the tool assembly 52 is shown in FIG. 6B and includes the lower post 58, the lower trim steel 61, the lower tab retainer pad 65, and the lower flange steel 63 arranged on the bottom die 55.

A fourth operation for manufacturing the roof body panel 10 is depicted in FIG. 4. The fourth operation results in the trimming of the four retention tabs 48 of the cross member 40 and the piercing of the hole 28 in each of the first and second locator tabs 24 as represented by the dash lines 64, 66. Each of the four retention tabs 48 are trimmed to the flange 20 represented by the dash line 64. The hole 28 of each of the first and second locator tabs 24 are also pierced in the fourth operation. The die (not show) used to trim the retention tabs 48 is also used to pierce the hole 28 of the first and second retention tabs 48. The diametrical dimensional tolerance achieved by this process for the hole 28 in each of the first and second locator tabs 24 is +0.1 mm. The locational and profile tolerance achieved by the process for the trimmed edges and formed flange is +/−0.5 mm.

Figure 7:
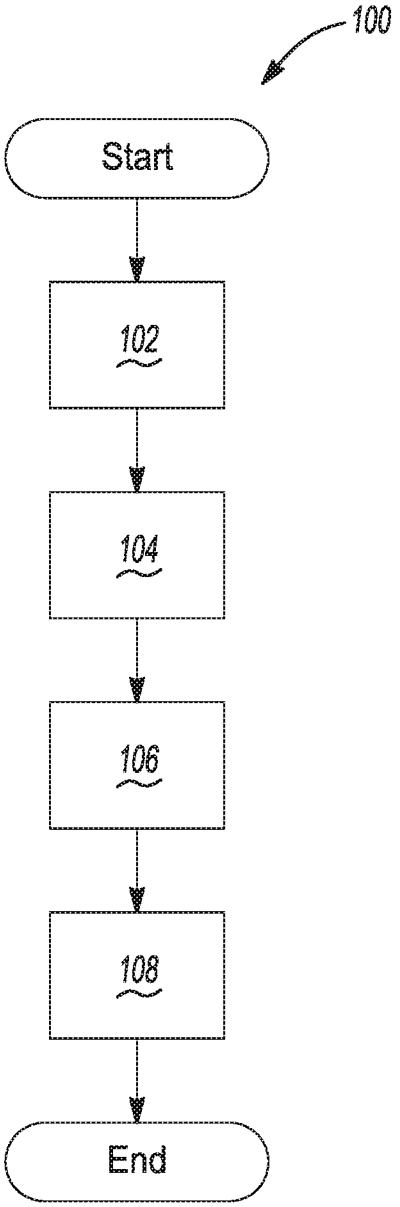
FIG. 7 is a flowchart depicting a method of manufacturing an automobile roof body panel, according to the present invention.

Referring now to FIG. 7, a flowchart depicting a method 100 for manufacturing the roof body panel 10 having the second sunroof opening 14 will now be described. The method 100 begins with a first step 102 of forming the roof body panel 10. The features formed in the first step 102 include the general shape, outer perimeter, and the strengthening channels 17 of the roof body panel 10. A second step 104 of the method 100 includes trimming the first, second, third, and fourth openings 30, 32, 34, 36 of the second sunroof opening 14 in a manner that retains the cross member 40 with the roof body panel 10. A third step 106 of the method 100 includes holding the cross member 40, trimming a portion of the cross member 40, and forming the flange 20 on the inner periphery of the second sunroof opening 14 using the tool assembly 52 as depicted in FIGS. 5A-5C, 6A and 6B. The four retention tabs 48 of the cross member 40, which are being held, are no longer connected to each other. A fourth step 108 of the method 100 includes finish trimming the four retention tabs 48 of the cross member 40 to the flange 20 and piercing the hole 28 into the first and second locator tabs 24.

The description of the invention is merely exemplary in nature and variations that do not depart from the gist of the invention are intended to be within the scope of the invention. Such variations are not to be regarded as a departure from the spirit and scope of the invention.

The following is claimed:

1. A method for manufacturing a body panel, the method comprising:

drawing a metal sheet into a body panel;

trimming the body panel to form a first, second, third, and fourth openings and a cross member, wherein the cross member extends from an edge of the first opening to an edge of the second opening and from an edge of the third opening to an edge of the fourth opening;

trimming a portion of the cross member to form a first, second, third, and fourth retention tabs;

forming a flange in the edge of the first opening, the edge of the second opening, the edge of the third opening, the edge of the fourth opening, and the first, second, third, and fourth retention tabs; and trimming the first, second, third, and fourth retention tabs at the edge of the first, second, third, and fourth openings.

2. The method for manufacturing a body panel of claim 1 further comprising providing a first tool assembly having an upper trim steel, and wherein the upper trim steel trims the portion of the cross member to form the first, second, third, and fourth retention tabs.

3. The method for manufacturing a body panel of claim 2 wherein providing a first tool assembly further comprises providing an upper flange steel to form the flange in the edge of the first, second, third, and fourth openings and the first, second, third, and fourth retention tabs.

4. The method for manufacturing a body panel of claim 1 wherein forming a flange further comprises holding the retention tabs while forming the flange.

5. The method for manufacturing a body panel of claim 4 wherein providing a first tool assembly further comprises providing a tab retainer to hold the retention tabs.

6. The method for manufacturing a body panel of claim 5 wherein trimming the first, second, third and fourth openings of the body panel further comprises trimming at least one locator tab in the edge of one of the first, second, third and fourth openings.

7. The method for manufacturing a body panel of claim 6 further comprising piercing a locator hole in the at least one locator tab.

8. The method for manufacturing a body panel of claim 7 further comprising providing a second tool assembly having an upper trim steel and wherein the upper trim steel trims the first and second retention tabs at the edge of the first and second opening.

9. The method for manufacturing a body panel of claim 8 wherein providing a second tool assembly further comprises providing a pierce die for piercing the locator hole into the at least one locator tab.

10. A method for manufacturing a body panel, the method comprising:

drawing a metal sheet into a body panel;

trimming the body panel to form a first, second, third, and fourth openings, a locator tab, and a cross member, wherein the cross member extends from an edge of the first opening to an edge of the second opening and from an edge of the third opening to an edge of the fourth opening and the locator tab extends from the edge of one of the first and second openings;

holding a first, second, third, and fourth retention portions of the cross member;

trimming a center portion of the cross member to separate the first, second, third, and fourth retention portions retention portions of the cross member from the center portion of the cross member;

forming a flange in the edge of the first opening, the edge of the second opening, the edge of the third opening, and the edge of the fourth opening and the first, second, third, and fourth retention portions of the cross member; and trimming the first, second, third, and fourth retention portions of the cross member at the edge of the first, second, third, and fourth openings.

11. The method for manufacturing a body panel of claim 10 further comprising providing a first tool assembly having an upper trim steel, and wherein the upper trim steel trims the center portion of the cross member to form the first, second, third, and fourth retention portions.

12. The method for manufacturing a body panel of claim 11 wherein providing a first tool assembly further comprises providing an upper flange steel to form the flange in the edge of the first, second, third, and fourth openings and the first, second, third, and fourth retention portions of the cross member.

13. The method for manufacturing a body panel of claim 12 wherein providing a first tool assembly further comprises providing a retainer member to hold the first, second, third, and fourth retention portions of the cross member.

14. The method for manufacturing a body panel of claim 13 further comprising piercing a locator hole in the locator tab.

15. The method for manufacturing a body panel of claim 14 further comprising providing a second tool assembly having an upper trim steel and wherein the upper trim steel trims the first, second, third, and fourth portions at the edge of the first, second, third, and fourth openings.

16. The method for manufacturing a body panel of claim 15 wherein providing a second tool assembly further comprises providing a pierce die for piercing the locator hole into the locator tab.

* * * * *